US006641515B2

(12) United States Patent
Ferri et al.

(10) Patent No.: US 6,641,515 B2
(45) Date of Patent: Nov. 4, 2003

(54) DEVICE FOR THE MANUFACTURE OF SELF-SUSTAINING CUPS OF THIN PAPER

(75) Inventors: Luigi Ferri, Turin (IT); Francesco Ferri, Turin (IT)

(73) Assignee: Ecopack S.p.A., Piobesi (IT)

( * ) Notice: Subject to any disclaimer, the term of this patent is extended or adjusted under 35 U.S.C. 154(b) by 0 days.

(21) Appl. No.: 10/208,783

(22) Filed: Aug. 1, 2002

(65) Prior Publication Data

US 2003/0026930 A1 Feb. 6, 2003

(30) Foreign Application Priority Data

Aug. 6, 2001 (EP) ..... 01830529

(51) Int. Cl.[7] ..... B31B 1/28; B31B 1/44
(52) U.S. Cl. ..... 493/158; 493/143; 72/348
(58) Field of Search ..... 493/143, 158; 72/348

(56) References Cited

U.S. PATENT DOCUMENTS

| | | | | |
|---|---|---|---|---|
| 2,447,855 A | | 8/1948 | Allen et al. | |
| 3,001,683 A | | 9/1961 | Campanelli et al. | |
| 3,065,677 A | * | 11/1962 | Loeser | 425/393 |
| 3,195,426 A | * | 7/1965 | Bauer | 493/103 |
| 3,229,886 A | * | 1/1966 | Grogel | 220/608 |
| 3,580,041 A | * | 5/1971 | Tilly et al. | 72/336 |
| 3,695,084 A | * | 10/1972 | Siemonsen et al. | 72/348 |
| 3,983,827 A | * | 10/1976 | Meadors | 264/293 |
| 4,127,378 A | * | 11/1978 | Meadors | 425/398 |
| 4,769,894 A | * | 9/1988 | Simpson | 29/437 |
| 4,778,439 A | * | 10/1988 | Alexander | 493/169 |
| 5,577,989 A | * | 11/1996 | Neary | 493/169 |
| 5,614,230 A | * | 3/1997 | Weyenberg et al. | 425/393 |
| 5,904,643 A | * | 5/1999 | Seeberger et al. | 493/59 |
| 6,527,687 B1 | * | 3/2003 | Fortney et al. | 493/56 |

* cited by examiner

*Primary Examiner*—Rinaldi I. Rada
*Assistant Examiner*—Hemant M Desai
(74) *Attorney, Agent, or Firm*—Guido Modiano; Albert Josif; Daniel O'Byrne

(57) ABSTRACT

A frustoconical matrix and a punch of a complementary shape and coaxial to the former can be brought together to shape an inserted sheet of thin paper. The matrix has a cylindrical peripheral surface along which a beading member comprising a cylindrical foil is slidable in a close running fit. A shoulder extends coaxially to the punch to define a pit having a cylindrical internal wall having a diameter smaller than the outside diameter of the beading member. Heating means are controllable to heat the shoulder to a temperature such that the pit is expanded to a diameter of close running fit between its internal wall and the beading member.

8 Claims, 3 Drawing Sheets

DEVICE FOR THE MANUFACTURE OF SELF-SUSTAINING CUPS OF THIN PAPER

BACKGROUND OF THE INVENTION

This invention is concerned with a device for the manufacture of self-sustaining cups of thin paper, suitable for containing foodstuffs and particularly cakes, pies, plum-cakes and the like, during the steps of baking, automatic or manual manipulation, exposure and sale.

It is known to accommodate certain foodstuffs such as mentioned above in drawn metal baking-pans that, during the baking step, possibly with insertion of paper cups ("pirottini" or baking cups), in order to avoid direct contact with metal.

Such cups, comprising radially plaited paper sheets having a frustoconical shape, are not self-sustaining, so that, without an embanking structure, they tend to buckle, both because of the tendency of the raw batter to become flabby and because of the natural expansion of the batter itself during the baking stage.

To this purpose, containers of corrugated paper are sometimes used which comprise two parts, namely a bottom and a lateral band to make a wall. Aluminium containers are also used.

It is also known to support plaited-paper cups in seats made in cardboard trays, so that the cup is laterally contained with the seat profile, while being easily withdrawn after baking.

However, since the above products are to be distributed industrially, the practice has developed of using cups which, while having an adequate sturdiness, can nevertheless be easily and unexpensively manufactured. This condition is not satisfactorily met by the above-mentioned approaches.

Due to the above reasons, substantially frusto-conical cups have been made in different sizes, not only from aluminium sheet, but also from cardboard (sometimes coupled to other materials). U.S. Pat. No. 5,184,995 and U.S. Pat. No. 6,093,460, for instance, show how to mould cardboard cups having a curled lip to build a peripheral containing bead, which imparts the structure a good resistance to its coming apart. The bead is formed by a beading member or by a molding in the die, which bends the lip of the cup to make a curl.

However, the approaches of U.S. Pat. No. 5,184,995 and U.S. Pat. No. 6,093,460 are both suitable for handling cardboard of considerable thickness, say having a basic weight of 200 g/sq.m. or more, and therefore having a good inherent stiffness, and are not suitable, on the other hand, for the manufacture of thin-paper cups, i.e. made of paper of 50 g/sq.m. or less, corresponding to a thickness of a few hundredths of a millimeter. As a person skilled in the art will appreciate, the degree of dimensional accuracy required for the different parts of the die increases as the paper thickness is reduced: in fact, if the gap between the movable and the stationary portions of the die is smaller than the thickness of the paper, the latter is liable to be torn, while, on the other hand, if the gap is too large, the paper is liable to be creased and be wedged between the parts of the die, thus jamming it. It is difficult to achieve so small dimensional tolerances and even more difficult to maintain them during the operation of the die machine, particularly in consideration of the circumstance that the die is also subject to heating, on the one hand because of friction, on the other hand because of deliberate heating for the purpose of thermoforming the paper.

Furthermore, the peripheral bead made of a single curl, as provided for in U.S. Pat. No. 5,184,995 and U.S. Pat. No. 6,093,460 with reference to cardboard, is not sufficient in the case of thin paper, on the one hand because it is unpractiv icable to build the required curl in the paper, on the other hand because anyway the curl is not stiff enough to impart the desired solidity to the cup.

Finally, wear of the dies due to operation would cause a quick decay of the accuracy of the die in any case, and would force replacement after a very short life period.

SUMMARY OF THE INVENTION

A main object of the invention is therefore to provide a device for the inexpensive mass-production of self-sustaining thin paper cups.

Another purpose is to extend the useful life of the dies used for thermoforming the cups.

The above objects and advantages are achieved by the invention, together with other advantages which will appear below, by providing a device for manufacturing self-sustaining cups, having the features set out in claim 1. The dependent claims recite other advantageous features.

BRIEF DESCRIPTION OF THE DRAWINGS

The inventive device will now be described in more detail, with reference to a preferred embodiment shown, by way of non limiting example, in the attached drawings, wherein.

DESCRIPTION OF THE PREFERRED EMBODIMENT

Figure 1:
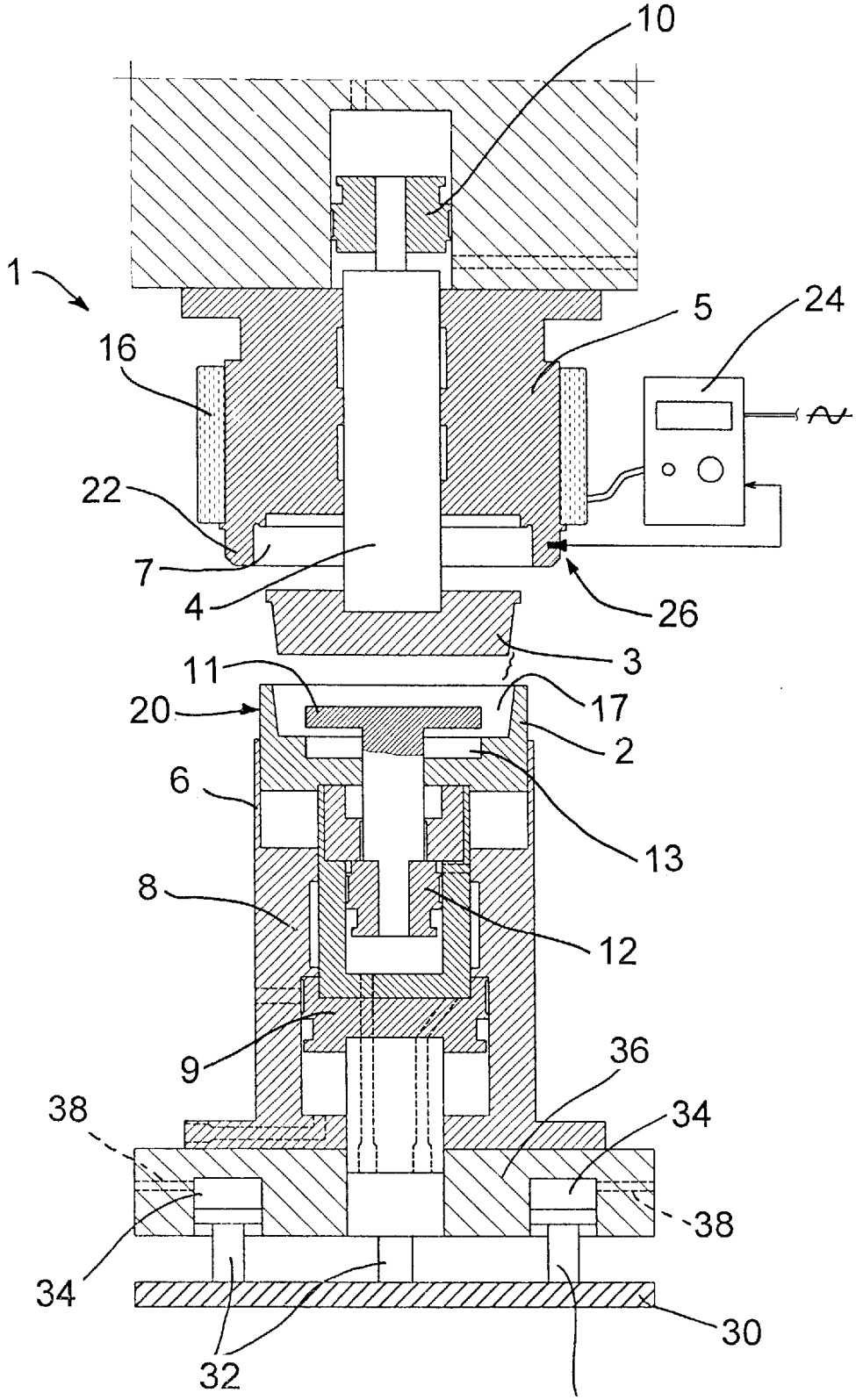
FIG. 1 shows, in an axial, vertical cross-section, a device for the manufacture of paper cups according to a preferred embodiment of the invention.

With reference to the Figures, a device 1 according to the preferred embodiment comprises a die matrix 2, axially slidable with respect to a base 8. Matrix 2 has a cavity 17 and is peripherally defined by a cylindrical wall 20. A punch 3, having a complementary shape to matrix 2, is coaxially arranged in front of matrix 2. Punch 3 is attached to a piston 4, which is itself axially slidable in a main block 5, opposite to base 8. Block 5 has a circular shoulder 22, preferably of brass, which projects frontally and coaxially to punch 3, thus defining a pit 7 having a cylindrical inside wall.

Both matrix 2 and piston 4 are normally biased to a position extended from base 8 and the main block 5 respectively, by means of first and second elastic means 9 and 10, advantageously compressed air springs, acting in opposition, wherein elastic means 10 have a stiffness characteristic lower than elastic means 9.

A beading member 6 comprising a thin cylindrical foil coaxial to base 8 and integral with it, is arranged coaxially and slidably, in close running fit, on the cylindrical outside surface of matrix 2. Beading member 6 is adapted to axially enter an annular gap 15 (FIG. 4) between the cylindrical internal wall of pit 7 and the cylindrical external surface of matrix 2, when they are in axially overlapping mutual positions, according to a sequence of operational steps as described in detail below.

A knockout pan 11 extends from the bottom of matrix 2, being biased by a third compressed-air cylinder 12, acting as an elastic means, having a stiffness lower than the other elastic means on the average.

The bottom of matrix 2 has a depression 13 to receive knockout pan 11, the latter being adapted to completely withdraw within it.

Base 8 is axially movable relative to main block 5, under the action of a lifting device comprising a platform 30 bearing a set of four circumferentially spaced pistons such as 32, that are slidably received in respective cavities such as 34, made in an understructure 36 to base 8. Hydraulic fluid can be supplied to each cavity 34 through conduits 38 to lift base 8 toward main block 5. Alternatively, base 8 might be made stationary and block 5 movable.

Electric resistances 16 are wound around main block 5 to heat the block, which resistances are powered by an external voltage source (not shown), by the intermediary of a voltage regulator shown diagrammatically as 24, controlled by a temperature probe 26 mounted on shoulder 22, so that the pit is maintained at a desired temperature which is suitable for thermoforming the paper, the temperature being typically chosen in a range of 140 to 200° C.

The device of FIG. 1 is designed so that, when it is inactive and electric resistances 16 are off, i.e. when the device is cool, the internal diameter of pit 7 is slightly smaller than the external diameter of beading member 6, i.e. so that there is interference between the side wall of pit 7 and the external surface of beading member 6. When block 5 is heated by resistances 16, the pit expands and, when its temperature attains a predetermined nominal value (say 180° C.), a condition of close running fit pevails between the wall of pit 7 and beading member 6.

Figure 2:
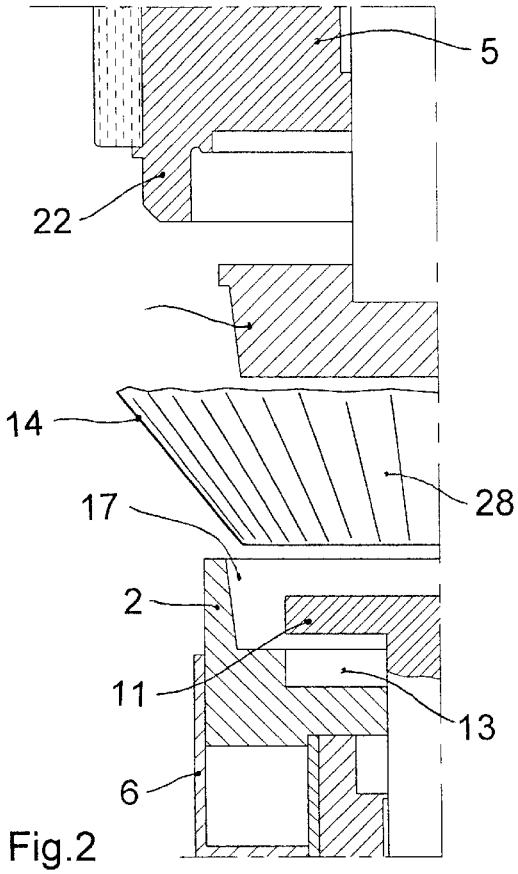
FIGS. 2, 3, 4, 5, 6 are partial cross-sections, to an enlarged scale, similar to FIG. 1, showing successive steps in the operation of the device.

In a first embodiment, the manufacture of the self-sustaining cup starts from a semifinished cup or "pirottino" 28 (FIG. 2), i.e. a disk of thin paper which has been plaited radially to take a frustoconical shape and having a peripheral edge exceeding the desired depth of the finished cup. After pre-heating block 5 to a predetermined temperature, say 180° C., cup 28 is brought to the position shown on FIG. 2, between matrix 2 and punch 3 by means of manipulator means, not shown, obvious for a person skilled in the art, such as are conventionally used for transferring workpieces being processed on automatic-production lines or plants.

The operating steps now follow as shown on FIGS. 2 to 6, as described below.

Figure 3:
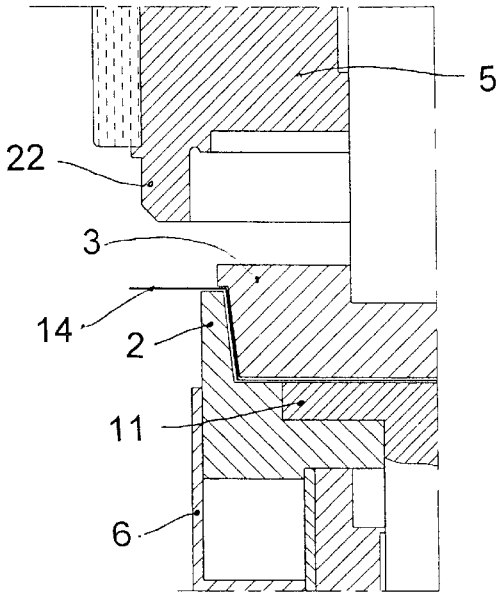

When cup 28 has been placed between matrix 2 and punch 3 (FIG. 2), base 8 is moved vertically toward main block 5, under the action of lifting means 34, 36, until cup 28 is squeezed between punch 3 and pan 11, the latter withdrawing to flatness after matrix 2 has coupled with punch 3 and has trapped cup 28 therebetween (FIG. 3).

At this point, as the approaching stroke continues, piston 4 starts to withdraw, the stiffness of second elastic means 10 being smaller than first elastic means 9, and eventually the piston reaches its limit.

Figure 4:
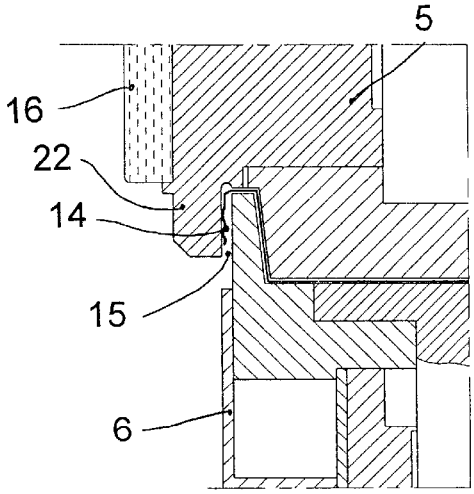

During this step, peripheral edge 14 abuts against shoulder 22 and is first bent to make a flap at right angles to the axis of the die (FIG. 3) and then is bent again along the lateral wall of pit 7, substantially lying as a cylinder within the annular gap 15 which is formed between lateral wall of pit 7 and external wall of the matrix (FIG. 4).

Figure 5:
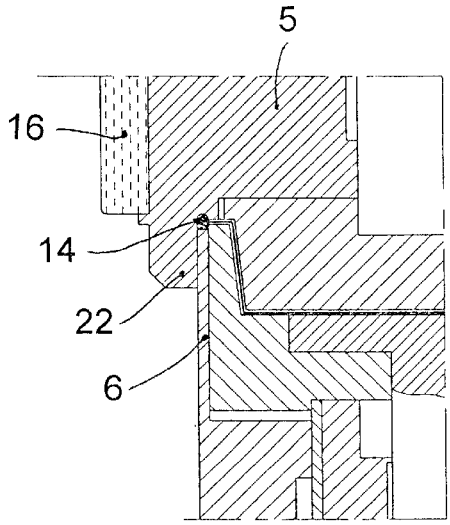
Figure 6:
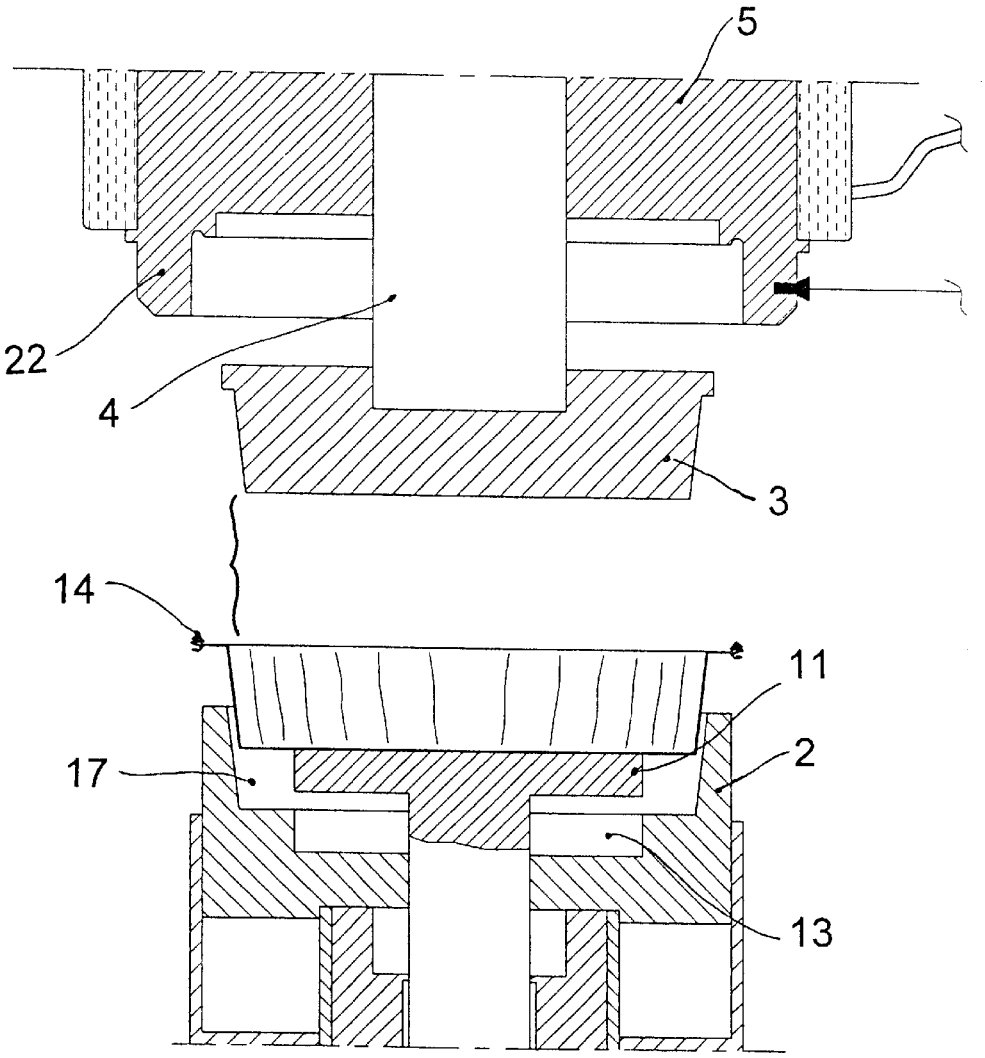
Figure 7:
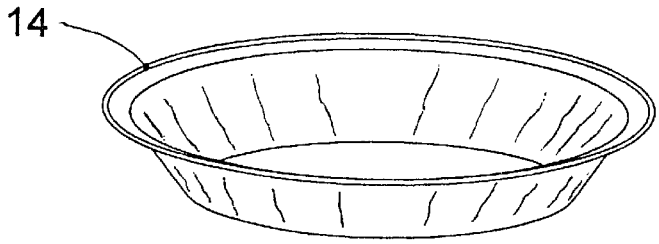
FIG. 7 is a perspective view of a finished cup, made by the device of FIGS. 1 to 6.

After piston 4 has reached its limit, matrix 2 also starts to withdraw so that beading member 6 enters annular gap 15, thus squeezing and compacting peripheral edge 14, the latter being securely contained within annular gap 15, due to the close running fit between the beading member and both sliding walls inside and outside (FIG. 5).

The device is maintained in the condition of FIG. 5 for a short predetermined time, such that the paper material of the cup, and particularly the material that has been compacted in a ring 14 undergoes a thermal processing with a partial molecular alteration having a consolidating effect, which is sufficient to stabilize the shape forced by the die. At this point, the die is opened (FIG. 6) and the finishe cup is unloaded, while a fresh "pirottino" is placed as on FIG. 2, for a fresh operating cycle.

A person skilled in the art will appreciate that the temperature can be regulated with accuracy to a value that will provide the close running fit between the parts of the die, and the dwelling time of the device in closed condition can then be chosen so that the thermal processing of the paper is optimized. As known, the thermoforming temperature of the paper can vary within a broad range, provided that the dwelling time is changed to compensate for it. This circumstance makes it practicable to compensate for the wear of the pit and of the beading member, whereby the working temperature is progressively reduced (and therefore also the expansion of the pit), while the dwelling time is simultaneously increased, within reasonable bounds.

By the teachings of the invention it is possible to thermoform paper of a thickness of a few hundredths of a millimeter, which, in a conventional die, would inevitably penetrate within then interfaces between the sliding parts, with an ease that would increase as the die is worn down, causing not only misshapen products, but also jamming and downtime of the equipment.

Persons skilled in the art will appreciate that the invention takes advantage of the thermal expansion of the main block in order to compensate for the clearances between the parts sliding relative to each other.

An advantage of the invention is that the life of the dies used for thermoforming the cups is considerably extended, so that frequent replacements of the parts subjected to wear are avoided.

The preferred embodiment as described above may be subjected to numerous changes and modifications, within the scope of the inventive concept, and several details might be replaced with other, technically equivalent parts. For instance, the elastic means could be simple wound springs or similar devices. Similarly, although an embodiment where the base is movable with respect to a stationary main block is preferred, it is possible to choose the opposite approach, or even to make both parts movable so that, under appropriate circumstances, the productivity is increased. Also, the heating means which have been disclosed might be replaced with other technically equivalent means; for example, it is possible to implant electrically heatable filaments within the wall of the main block.

Although the dies and the containers usually have a shape of a truncated cone with a circular base, differently shaped dies and containers could be used, for example having an oval base.

Finally, although, for convenience, the example disclosed refers to a starting product consisting of a preformed baking cup or "pirottino", it is also possible to start from a flat sheet, which is preliminarily or simultaneously punched to a disk.

What is claimed is:

1. A device for manufacture of self-sustaining cups of thin paper, comprising a frustoconical matrix and a punch of a complementary shape and coaxial to the former, the matrix and the punch being adapted to be brought together to shape an inserted sheet of said thin paper, wherein the matrix has a cylindrical peripheral surface along which a beading member comprising a cylindrical foil is slidable with a close running fit;

a shoulder extends coaxially to the punch to define a pit having a cylindrical internal wall having a diameter smaller than the outside diameter of the beading member;

heating means are controllable to heat the shoulder to a predetermined temperature such that the pit is expanded to a diameter of close running fit between its internal wall and the beading member.

2. The device of claim 1, wherein the matrix is supported on a base through the intermediary of first elastic means axially biasing the matrix to an extended position.

3. The device of claim 2, wherein the shoulder is supported on a main block and the punch is movably supported axially with respect to said block between a withdrawn position and an extended position, whereby second elastic means bias the punch to its extended position and the matrix when coming in contact with the punch pushes it to its withdrawn position.

4. The device of claim 3, wherein said first elastic means have a stiffness characteristic such that their resistance to compression is higher than said second elastic means.

5. The device of claim 1, wherein the matrix comprises a knockout pan which is outwardly biased by third elastic means having a stiffness characteristic that is, on the average, lower than said first and second elastic means.

6. The device of claim 2, wherein at least one of said first, second and third elastic means is a compressed-air cylinder.

7. The device of claim 5, wherein said knockout pan is receivable within a seat in the bottom of the matrix.

8. The device of claim 3, wherein said main block is stationary and said base is axially movable by the action of lifting means.

* * * * *